US010260293B2

(12) United States Patent
Dev et al.

(10) Patent No.: US 10,260,293 B2
(45) Date of Patent: Apr. 16, 2019

(54) SENSORLESS MANIFOLD ASSEMBLY WITH PRESSURE-BASED REVERSING FLUID CIRCUIT

(71) Applicant: General Electric Company, Schenectady, NY (US)

(72) Inventors: Bodhayan Dev, Niskayuna, NY (US); Aaron Christopher Noakes, Norman, OK (US); Brian Paul Reeves, Edmond, OK (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 264 days.

(21) Appl. No.: 15/409,337

(22) Filed: Jan. 18, 2017

(65) Prior Publication Data

US 2018/0202241 A1 Jul. 19, 2018

(51) Int. Cl.

| | |
|---|---|
| ***E21B 17/18*** | (2006.01) |
| ***E21B 43/12*** | (2006.01) |
| ***E21B 34/10*** | (2006.01) |

(52) U.S. Cl.

CPC ..... *E21B 17/18* (2013.01); *E21B 34/10* (2013.01); *E21B 43/127* (2013.01); *E21B 43/129* (2013.01)

(58) Field of Classification Search

CPC ..... E21B 17/18; E21B 34/10; E21B 34/101

See application file for complete search history.

(56) References Cited

U.S. PATENT DOCUMENTS 4,234,295 A * 11/1980 Jensen ..... F04B 9/107 417/390
4,536,137 A * 8/1985 Bookout ..... F04B 47/08 417/390
4,571,939 A 2/1986 Dollison (Continued)

FOREIGN PATENT DOCUMENTS

| | | |
|---|---|---|
| CN | 2346957 Y | 11/1999 |
| RU | 2121053 C1 | 10/1998 |
| WO | 01/09513 A1 | 2/2001 |

OTHER PUBLICATIONS

International Search Report and Written Opinion issued in connection with corresponding PCT Application No. PCT/US18/023199 dated Jul. 10, 2018.

*Primary Examiner* — Thomas E Lazo

(74) *Attorney, Agent, or Firm* — GE Global Patent Operation

(57) ABSTRACT

A downhole manifold assembly includes a manifold body defining a longitudinal axis and having a first end face, a second end face, and an outer surface extending therebetween. A fluid circuit is defined in the manifold body and includes a plurality of axially extending fluid passages and a plurality of radially extending fluid passages. The radially extending fluid passages extend to the outer surface of the manifold body. Each radially extending fluid passage defines a respective aperture in the outer surface. The manifold assembly also includes a control valve coupled to the manifold body. The control valve is positionable between a first position in which a flow of pressurized fluid is channeled through the fluid circuit in a first direction, and a second position in which the flow is reversed and the pressurized fluid is channeled through the fluid circuit in a second direction.

23 Claims, 13 Drawing Sheets

(56) References Cited

U.S. PATENT DOCUMENTS

| | | | | |
|---|---|---|---|---|
| 4,591,320 | A * | 5/1986 | Pope | F04B 47/08 417/390 |
| 4,707,993 | A | 11/1987 | Kime | |
| 5,592,973 | A * | 1/1997 | Pope | F04B 47/08 137/625.21 |
| 7,413,009 | B2 * | 8/2008 | Jacobs | F04B 47/06 166/105 |
| 7,417,920 | B2 | 8/2008 | Hahn et al. | |
| 8,365,821 | B2 | 2/2013 | Hall et al. | |
| 8,627,883 | B2 | 1/2014 | Richards | |
| 2004/0060290 | A1 | 4/2004 | Stahlman | |
| 2005/0247359 | A1 | 11/2005 | Hiser | |
| 2006/0201321 | A1 | 9/2006 | Loedige et al. | |
| 2006/0218912 | A1 | 10/2006 | Price et al. | |
| 2015/0308243 | A1 | 10/2015 | Hallundbäk et al. | |
| 2016/0131130 | A1 | 5/2016 | Lei et al. | |
| 2018/0187673 | A1 | 7/2018 | Trivedi et al. | |

* cited by examiner

SENSORLESS MANIFOLD ASSEMBLY WITH PRESSURE-BASED REVERSING FLUID CIRCUIT

BACKGROUND

The field of the invention relates generally to oil and gas downhole pump assemblies and, more specifically, to a sensorless manifold assembly for use in oil and gas pumping operations.

At least some known rod pumps are used in oil and gas wells, for example, to pump fluids from subterranean depths towards the surface. In operation, a pump assembly is placed within a well casing, well fluid enters the casing through perforations, and mechanical lift forces the fluids from subterranean depths towards the surface. For example, at least some known rod pumps utilize a downhole pump with complicated geometry, which by reciprocating action of a rod string, lifts the well fluid towards the surface.

In some known oil and gas well pump systems, a hydraulic manifold assembly is used to facilitate the reciprocating action required for pumping fluid. In certain known systems, such manifold assemblies rely on one or more electronic components for providing flow reversal of the hydraulic fluid to operate the downhole pump. However, due to the harsh conditions inherent in downhole pumping operations, such electronic components may have reduced reliability, which may reduce the operational life of the manifold assembly and increase costs and downtime for repairs and replacements. Moreover, in some known systems, operators rely on batteries with limited lifespans, expensive downhole generators, and/or long power supply lines to provide adequate power to the electronic components.

BRIEF DESCRIPTION

In one aspect, a downhole manifold assembly is provided. The manifold assembly includes a manifold body defining a longitudinal axis and having a first end face, a second end face, and an outer surface extending therebetween. The manifold assembly also includes a fluid circuit defined therein. The fluid circuit includes a plurality of axially extending fluid passages defined in the manifold body, and a plurality of radially extending fluid passages defined in the manifold body. The radially extending fluid passages extend to the outer surface of the manifold body. Each radially extending fluid passage of the plurality of radially extending fluid passages defines a respective aperture in the outer surface. In addition, the manifold assembly includes a control valve coupled to the manifold body. The control valve is positionable between a first position in which a flow of pressurized fluid is channeled through the fluid circuit in a first direction, and a second position in which the flow is reversed and the pressurized fluid is channeled through the fluid circuit in a second direction.

In another aspect, a downhole pump system is provided. The pump system includes downhole tubing and a pump assembly coupled to the downhole tubing. The pump assembly includes a piston housing including a head end and a base end opposite the head end. The pump assembly also includes a drive piston disposed within a piston housing and movable between a first piston position proximate to the head end and a second piston position proximate to the base end. In addition, the pump assembly includes a manifold assembly disposed within the downhole tubing. The manifold assembly includes a cylindrical manifold body defining a longitudinal axis and having a first end face, a second end face, and an outer surface extending therebetween. The manifold assembly also includes a plurality of circumferentially-extending grooves defined in the outer surface and spaced axially along the cylindrical manifold body. Moreover, the manifold assembly includes a fluid circuit defined therein and coupled in flow communication with the head end and the base end of the piston housing. The fluid circuit includes a plurality of radially extending fluid passages defined in the cylindrical manifold body and extending to the outer surface. Each radially extending fluid passage of the plurality of radially extending fluid passages defines a respective aperture in the outer surface. A single respective aperture is positioned between adjacent grooves of the plurality of circumferentially-extending grooves.

In yet another aspect, a method for assembling a manifold assembly is provided. The method includes providing a cylindrical manifold body and forming a plurality of axially extending fluid passages in the cylindrical manifold body. In addition, the method includes forming a plurality of radially extending fluid passages in the cylindrical manifold body. Each radially extending fluid passage of the radially extending fluid passages extends to an outer surface of the cylindrical manifold body. The method also includes forming a plurality of circumferentially-extending grooves in the outer surface of the cylindrical manifold body. The plurality of circumferentially-extending grooves are spaced axially along the cylindrical manifold body. A single radially extending fluid passage extends to the outer surface between adjacent grooves of the plurality of circumferentially-extending grooves.

DRAWINGS

These and other features, aspects, and advantages of the present disclosure will become better understood when the following detailed description is read with reference to the accompanying drawings in which like characters represent like parts throughout the drawings, wherein.

Figure 1:
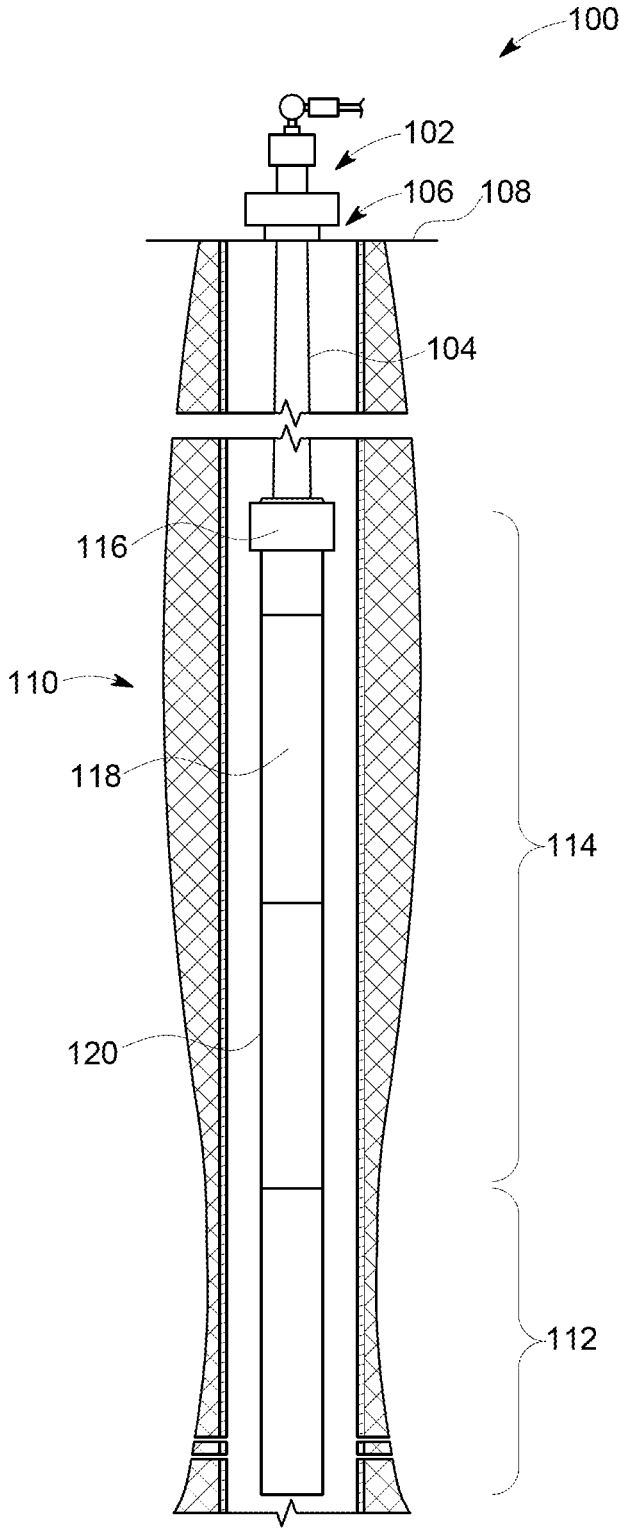
FIG. 1 is a perspective schematic illustration of an exemplary downhole pump system.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

The actuator assemblies described herein facilitate extending pump operation in harsh oil and gas well environments. Specifically, the actuator assemblies described herein include a manifold assembly configured to reverse the fluid flow into a head end and base end of a piston assembly, without necessitating reversal in rotation of a hydraulic pump. In particular, the manifold assembly includes a control valve configured to alternately direct pressurized hydraulic fluid into the head end and base end of the piston assembly, and induce corresponding movement of a drive piston disposed within the piston assembly. The control valve is switched between two configurations, each configuration corresponding to a different fluid flow path, in response to feedback provided by a fluid pressure-based position feedback system. The manifold body is sized to fit within downhole tubing and includes a plurality of fluid passages defining the primary fluid system of the hydraulic fluid and the pressure-based position feedback system. The manifold assembly facilitates providing a compact manifold body that defines a fluid pressure feedback system that is sensorless, i.e., free of electronic sensors, and includes a plurality of fluid valves arranged and oriented within downhole space constraints. In addition, the compact manifold body is configured to facilitate ease of manufacturing by using standard drilling techniques to define the fluid passages and cross-drilled passages for defining the fluid passage network. The manifold body also includes a plurality of surface features configured to enable isolation of each cross-drilled passage from another cross-drilled passage.

FIG. 1 is a perspective schematic illustration of an exemplary downhole pump system 100. In the exemplary embodiment, pump system 100 includes a well head 102, downhole tubing 104 coupled to well head 102, and a pump assembly 110 coupled to downhole tubing 104 and positioned within a well bore 106. Well bore 106 is drilled through a surface 108 to facilitate the production of subterranean fluids such as, but not limited to, water and/or petroleum fluids. As used herein, "petroleum fluids" may refer to mineral hydrocarbon substances such as crude oil, gas, and combinations thereof.

In the exemplary embodiment, pump assembly 110 includes a piston rod pump assembly 112 coupled to an end of a hydraulic actuator 114. Hydraulic actuator 114 is configured to actuate piston rod pump assembly 112, and typically includes a hydraulic power section 116, a control section 118, and a piston section 120. Piston section 120 is formed, at least in part, from a piston housing 236 and a drive piston 122 (shown in FIGS. 3 and 4). Drive piston 122 is disposed within piston section 120 and is driven by hydraulic fluid supplied by hydraulic power section 116. Hydraulic power section 116 is controlled by control section 118. Specifically, in the exemplary embodiment, power section 116 provides pressurized hydraulic fluid to drive piston 122 while control assembly 118 dynamically redirects the pressurized hydraulic fluid provided by power section 116 to facilitate reciprocation of drive piston 122.

Figure 2:
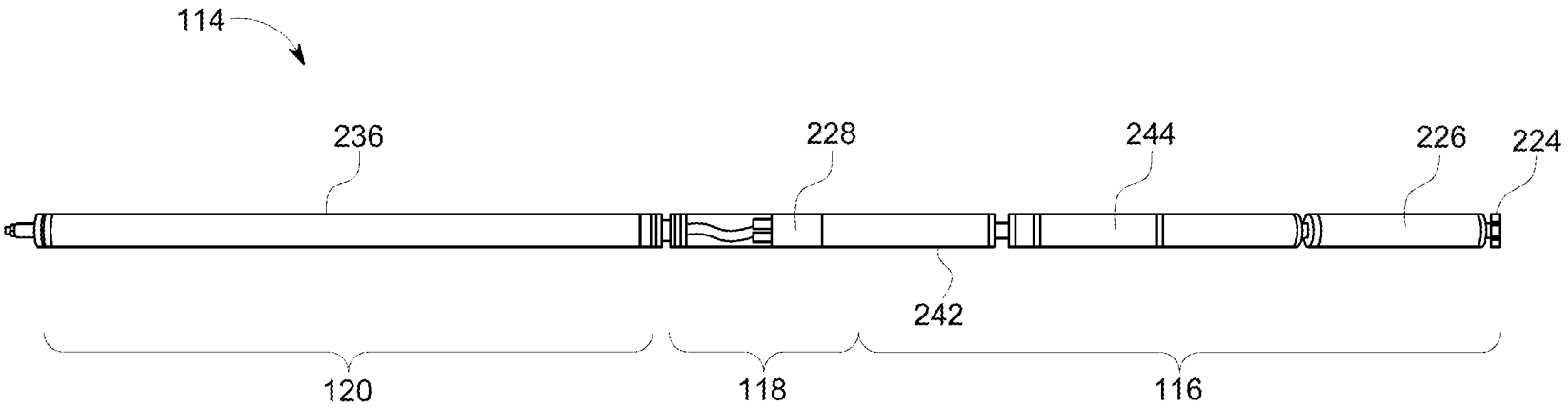
FIG. 2 is a schematic view of an exemplary hydraulic actuator that may be used in the downhole pump system of FIG. 1.
Figure 3:
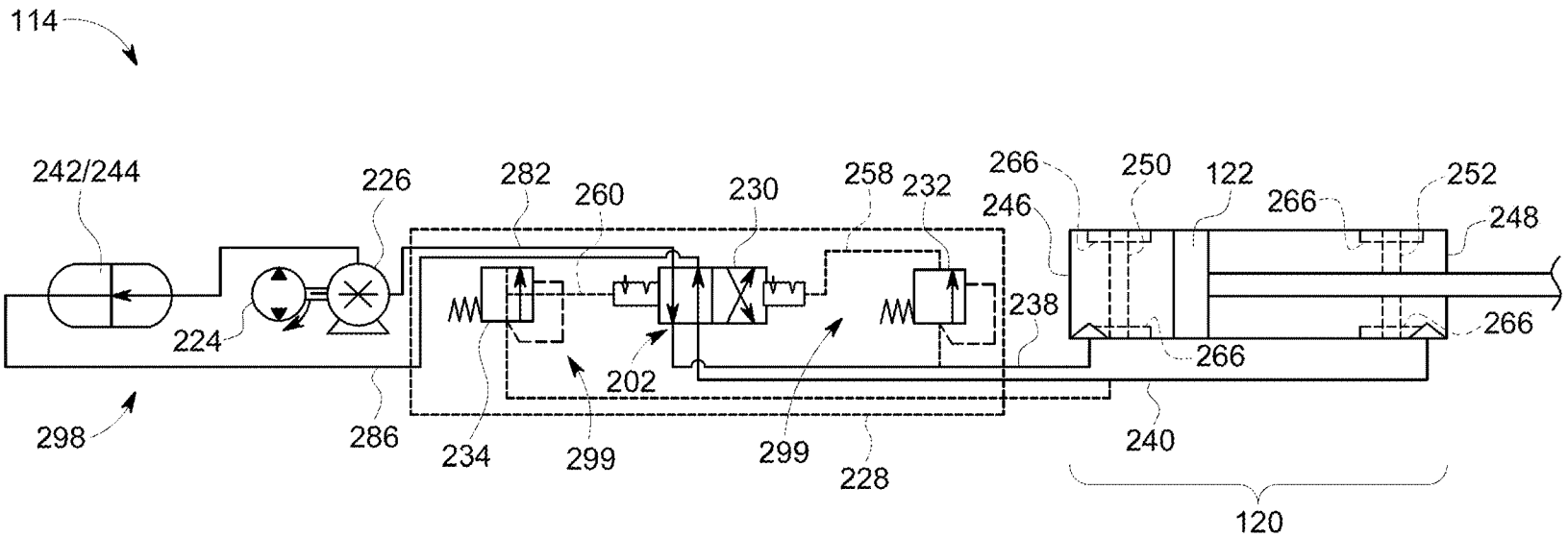
FIG. 3 is a schematic illustration of the hydraulic actuator shown in FIG. 2 showing a control valve in a first control valve position.
Figure 4:
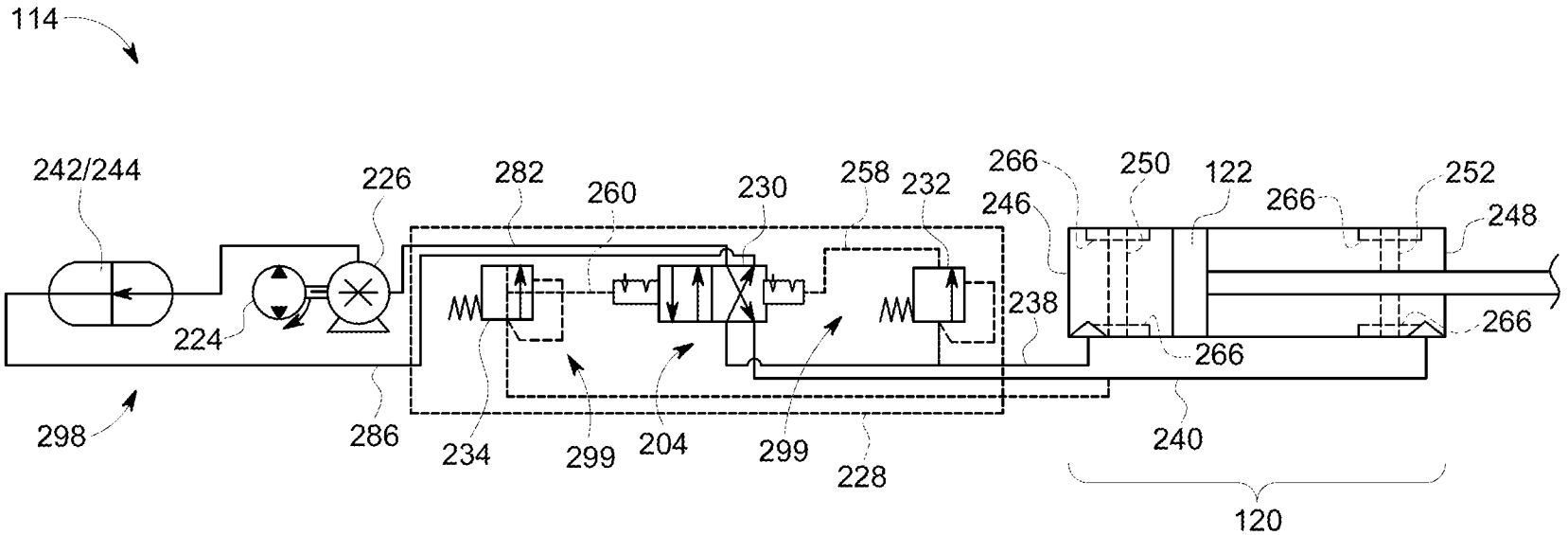
FIG. 4 is a schematic illustration of the hydraulic actuator shown in FIG. 2 showing the control valve in a second control valve position.
Figure 5:
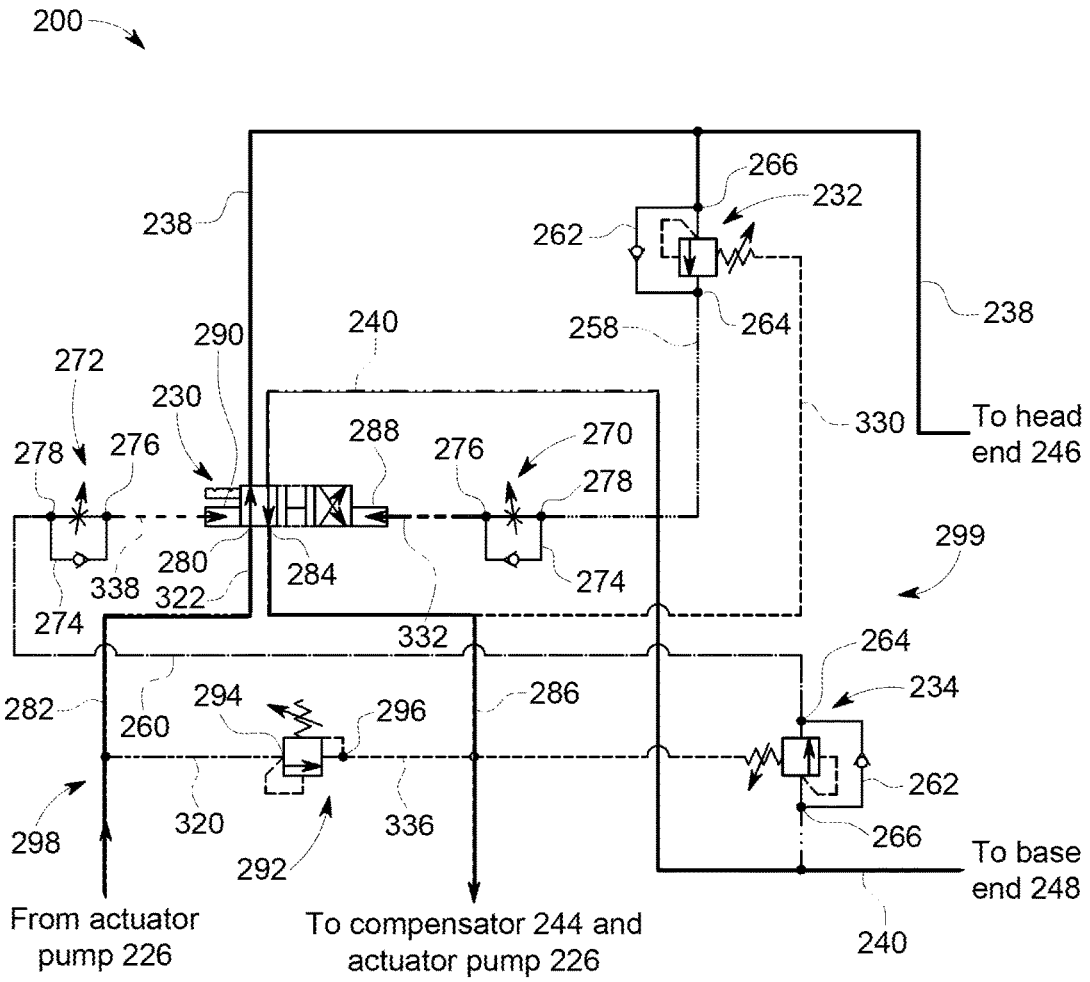
FIG. 5 is a schematic illustration of an exemplary fluid circuit of an exemplary manifold assembly for use in the hydraulic actuator shown in FIGS. 2-4.

FIG. 2 is a schematic view of an exemplary hydraulic actuator 114 that may be used in downhole pump system 100 (shown in FIG. 1). FIG. 3 is a schematic illustration of hydraulic actuator 114 showing a control valve 230 in a first control valve position 202. FIG. 4 is a schematic illustration of hydraulic actuator 114 showing control valve 230 in a second control valve position 204. FIG. 5 is a schematic illustration of an exemplary fluid circuit 200 of an exemplary mechanical valve manifold assembly 228 for use in hydraulic actuator 114 (shown in FIGS. 2-4). In the exemplary embodiment, power section 116 includes an actuator motor 224 and an actuator pump 226. Actuator pump 226 is coupled in fluid communication with control section 118 and, more specifically, with valve manifold assembly 228 disposed within control section 118. Power section 116 also includes a compensator bag or compensator 244 that functions as a fluid volume storage device for hydraulic actuator 114 as well as actuator pump 226. Compensator 244 facilitates damping of pump pulsations transmitted through the fluid as well as energy storage, shock absorption, and other reservoir functions (e.g., fluid leakage make-up and fluid volume compensation due to temperature changes, etc.). In alternative embodiments, hydraulic actuator 114 further includes an accumulator 242 and/or a combination of accumulator 242 and compensator 244 to facilitate accounting for variations in fluid volume during operation of hydraulic actuator 114, and in particular during a transition of control valve 230.

In the exemplary embodiment, control section 118 is sensorless, i.e., free of electronic sensors, and includes mechanical valve manifold assembly 228, which includes fluid circuit 200. Fluid circuit 200 includes a primary fluid system 298 and a pressure-based position feedback system 299. Pressure-based position feedback system 299 includes a first pressure actuated valve 232 and a second pressure actuated valve 234 coupled in fluid communication with control valve 230 through a first hydraulic control passage 258 and a second hydraulic control passage 260, respectively. In the exemplary embodiment, first pressure actuated valve 232 and second pressure actuated valve 234 are pilot-operated sequence valves. For example, and without limitation, pressure actuated valves 232 and 234 are direct-acting sequence valves having an integral check valve circuit 262 to provide reverse flow from a sequence port 264 to an inlet port 266. Pressure actuated valves 232 and 234 supply a secondary circuit (e.g., hydraulic control passages 258 and 260) with fluid flow once the pressure at inlet port 266 has exceeded a predetermined pressure threshold. In alternative embodiments, first and second pressure actuated valves 232 and 234 are any suitable valves configured to actuate in response to detecting a predetermined pressure.

Hydraulic control passages 258 and 260 also include inline needle valves 270 and 272, respectively. Needle valves 270 and 272 are fully adjustable needles valves with an integral check valve circuit 274 to provide reverse flow from an outlet port 276 to an inlet port 278. Each needle valve 270 and 272 is a fully adjustable orifice used in pressure-based position feedback system 299 to regulate fluid flow. Needle valves 270 and 272 are infinitely adjustable from a fully closed configuration in which fluid in prevented from flowing, up to a predetermined maximum orifice diameter, in which fluid is facilitated to flow through the valve. Needle valves 270 and 272 are not pressure compensated valves. In alternative embodiments, inline needle valves 270 and 272 are any suitable valves configured to regulate fluid flow.

In the exemplary embodiment, primary fluid system 298 includes actuator pump 226, piston section 120, control valve 230, and connecting fluid passages as described herein. Control valve 230 includes a pressure port or fluid supply port 280 that receives the pressurized fluid from actuator pump 226 through a fluid supply passage 282. Control valve 230 also includes a tank port or fluid exit port 284 that channels the pressurized fluid back to actuator pump 226 through a fluid return passage 286. In particular, fluid exit port 284 receives the pressurized fluid from at least one of a head end hydraulic passage 238 (i.e., circuit "A") and a base end hydraulic passage 240 (i.e., circuit "B") of primary fluid system 298. In the exemplary embodiment, head end hydraulic passage 238 channels the pressurized fluid between control valve 230 and a head end 246 of piston housing 236. Base end hydraulic passage 240 channels the pressurized fluid between control valve 230 and a base end 248 of piston housing 236. Coupled in line between fluid supply passage 282 and fluid return passage 286 is a pressure relief valve 292. In the exemplary embodiment, pressure relief valve 292 is, for example, and without limitation, a direct-acting pressure relief valve that is a normally closed, pressure-limiting valve used to protect components of pump assembly 110 (e.g., components of fluid circuit 200 described herein) from pressure transients in the pressured fluid. For example, pressure relief valve 292 is a safety valve typically used in fluid circuit 200 to protect downhole pump system 100 from high pressure pulses and/or spikes in the fluid. In the exemplary embodiment, an inlet port 294 is coupled in fluid communication to fluid supply passage 282, and a tank port 296 is coupled in fluid communication to fluid return passage 286. When a fluid pressure at inlet port 294 reaches a predetermined pressure, pressure relief valve 292 starts to open to tank port 296, thereby throttling the pressurized fluid to facilitate limiting a fluid pressure rise in fluid supply passage 282.

In operation, drive piston 122 reciprocates between a first piston position 250 proximate to head end 246 of piston housing 236 and second piston position 252 proximate to base end 248 of piston housing 236. To facilitate reciprocation of drive piston 122, control valve 230 is configured to selectively channel fluid from actuator pump 226, which is driven by actuator motor 224, in an alternating flow direction between head end 246 and base end 248. Control valve 230 alternates the direction of the fluid flow through control valve 230 in response to a physical position of drive piston 122 within piston housing 236. In particular, control valve 230 is configured to operate in first control valve position 202 (shown in FIG. 3) in which, for example, pressurized fluid provided by actuator pump 226 is directed into head end 246 through head end hydraulic passage 238, and second control valve position 204 (shown in FIG. 4) in which, for example, the pressurized fluid is directed into base end 248 through base end hydraulic passage 240. As the pressurized fluid is provided into head end 246, drive piston 122 is moved to second piston position 252 proximate to base end 248. Similarly, as pressurized fluid is provided into base end 248, drive piston 122 is moved to first piston position 250 proximate to head end 246. Accordingly, as control valve 230 alternates between first control valve position 202 and second control valve position 204, drive piston 122 reciprocates within piston housing 236.

Control valve 230 switches between first control valve position 202 and second control valve position 204 in response to positional feedback provided by first pressure actuated valve 232 and second pressure actuated valve 234. As described herein, first pressure actuated valve 232 is coupled in fluid communication with head end 246 of piston housing 236 through head end hydraulic passage 238. Second pressure actuated valve 234 is coupled in fluid communication with base end 248 through base end hydraulic passage 240. In alternative embodiments, first pressure actuated valve 232 and second pressure actuated valve 234 are otherwise coupled in fluid communication to each of head end 246 and base end 248 to detect hydraulic fluid pressure corresponding to each of head end 246 and base end 248, respectively. For example, in some embodiments, first pressure actuated valve 232 and second pressure actuated valve 234 are coupled in fluid communication with head end 246 and base end 248, respectively, through pressure taps installed in head end 246 and base end 248 of piston housing 236.

Each of first pressure actuated valve 232 and second pressure actuated valve 234 are configured to actuate in response to experiencing a predetermined fluid pressure. In the exemplary embodiment, first pressure actuated valve 232 is configured to actuate in response to a head end pressure exceeding a predetermined head end pressure threshold, and second pressure actuated valve 234 is configured to actuate in response to a base end pressure exceeding a predetermined based end pressure threshold. More specifically, first pressure actuated valve 232 is coupled in fluid communication with head end 246 by head end hydraulic passage 238 and actuates in response to a pressure within head end hydraulic passage 238 corresponding to a head end pressure exceeding the predetermined head end pressure threshold. For example, as drive piston 122 is moved to first piston position 250 (i.e., drive piston 122 dead ends against head end 246), a pressure in the hydraulic fluid is increased, or spikes, to a pressure exceeding the predetermined head end pressure threshold. Similarly, second pressure actuated valve 234 is coupled in fluid communication with base end 248 by base end hydraulic passage 240 and actuates in response to a pressure within base end hydraulic passage 240 corresponding to a base end pressure exceeding the predetermined base end pressure threshold.

When control valve 230 is in second control valve position 204, control valve 230 directs fluid provided by actuator pump 226 into base end 248 and drive piston 122 moves towards head end 246. As drive piston 122 moves towards head end 246, pressure within base end hydraulic passage 240 increases until the predetermined base end pressure threshold is exceeded. When the predetermined head end pressure threshold is exceeded, second pressure actuated valve 234 actuates, causing pressurized fluid to flow through inline needle valve 272, which channels at least a portion of the pressured fluid to a second pilot port 290 in control valve 230 through hydraulic control passage 260 to translate control valve 230 into first control valve position 202. In the exemplary embodiment, the predetermined base end pressure threshold is selected such that second pressure control valve 234 actuates when drive piston 122 is located substantially in first piston position 250, thereby providing positional feedback corresponding to the position of drive piston 122 within piston housing 236.

In first control valve position 202, control valve 230 directs fluid provided by actuator pump 226 into head end 246 and drive piston 122 moves towards base end 248. As drive piston 122 moves towards base end 248, pressure within base end hydraulic passage 238 increases until the predetermined base end pressure threshold is exceeded. When the predetermined base end pressure threshold is exceeded, first pressure actuated valve 232 actuates, causing pressurized fluid to flow through inline needle valve 270, which channels at least a portion of the pressured fluid to a first pilot port 288 in control valve 230 through hydraulic control passage 258 to translate control valve 230 into second control valve position 204. In the exemplary embodiment, the predetermined base end pressure threshold is selected such that first pressure actuated valve 232 actuates when drive piston 122 is located substantially in second piston position 252. The foregoing processes of control valve 230 redirecting fluid alternately into head end 246 and base end 248 are repeated as the fluid is pressurized and channeled through fluid circuit 200 to facilitate reciprocating motion of drive piston 122.

In the exemplary embodiment, control valve 230 is a two-position, detented, four-way directional valve. Alternatively, control valve 230 may be a three-position, detented, four-way valve or any other valve configuration that enables pump system 100 to function as described herein. In the exemplary embodiment, control valve 230 includes an internal mechanical detent (not shown) that facilitates holding the valve in position until a minimum pilot fluid pressure is applied to one of pilot ports 288 and 290 of control valve 230. For example, in the exemplary embodiment, control valve 230 is switched between first control valve position 202 and second control valve position 204 by applying the minimum pilot fluid pressure to one of pilot ports 288 and 290, where control valve 230 remains in that position, with no pilot fluid pressure applied, until a new pilot fluid pressure signal is temporarily applied to the opposite pilot port 288 or 290. As such, control valve 230 is configured to remain in either first control valve position 202 or second control valve position 204 until either first pressure actuated valve 232 or second pressure actuated valve 234 is actuated, respectively. Accordingly, control valve 230 continues to channel pressurized fluid into head end 246 and/or base end 248 until drive piston 122 is substantially in second piston position 234 and first piston position 232, respectively.

Figure 6:
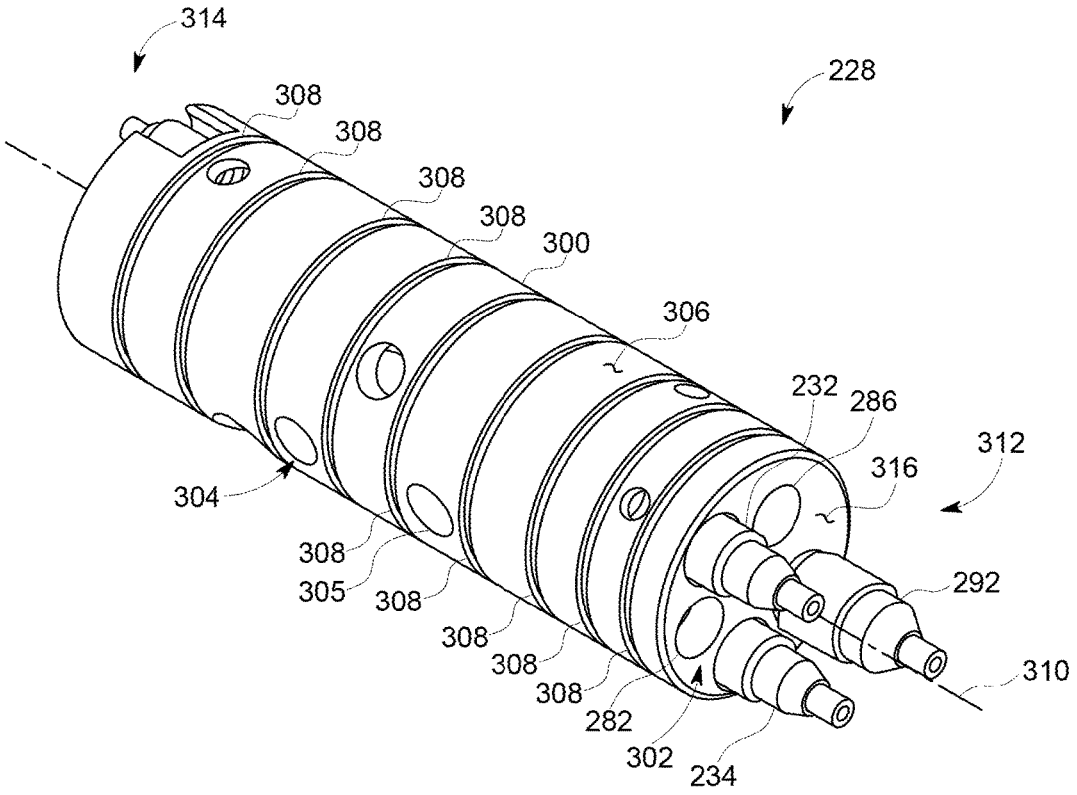
FIG. 6 is a perspective view of the manifold assembly for use in the hydraulic actuator shown in FIGS. 2-4.
Figure 7:
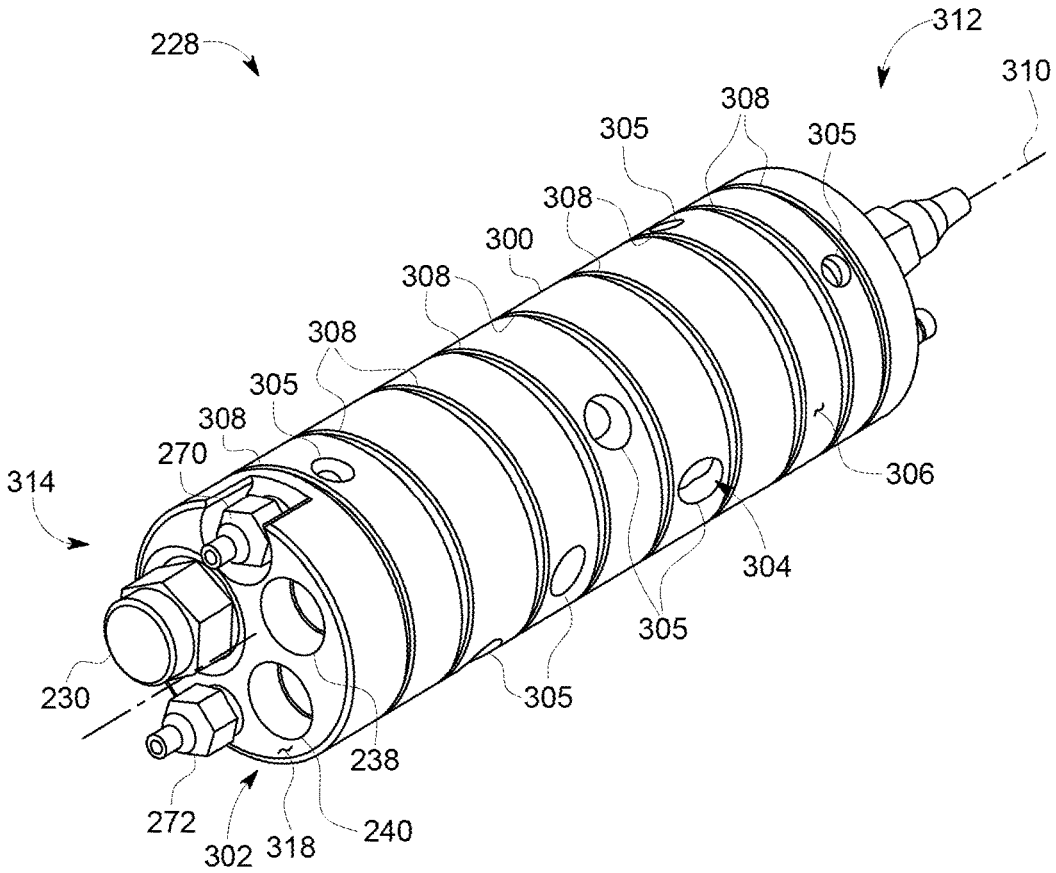
FIG. 7 is another perspective view of the manifold assembly shown in FIG. 6.
Figure 8:
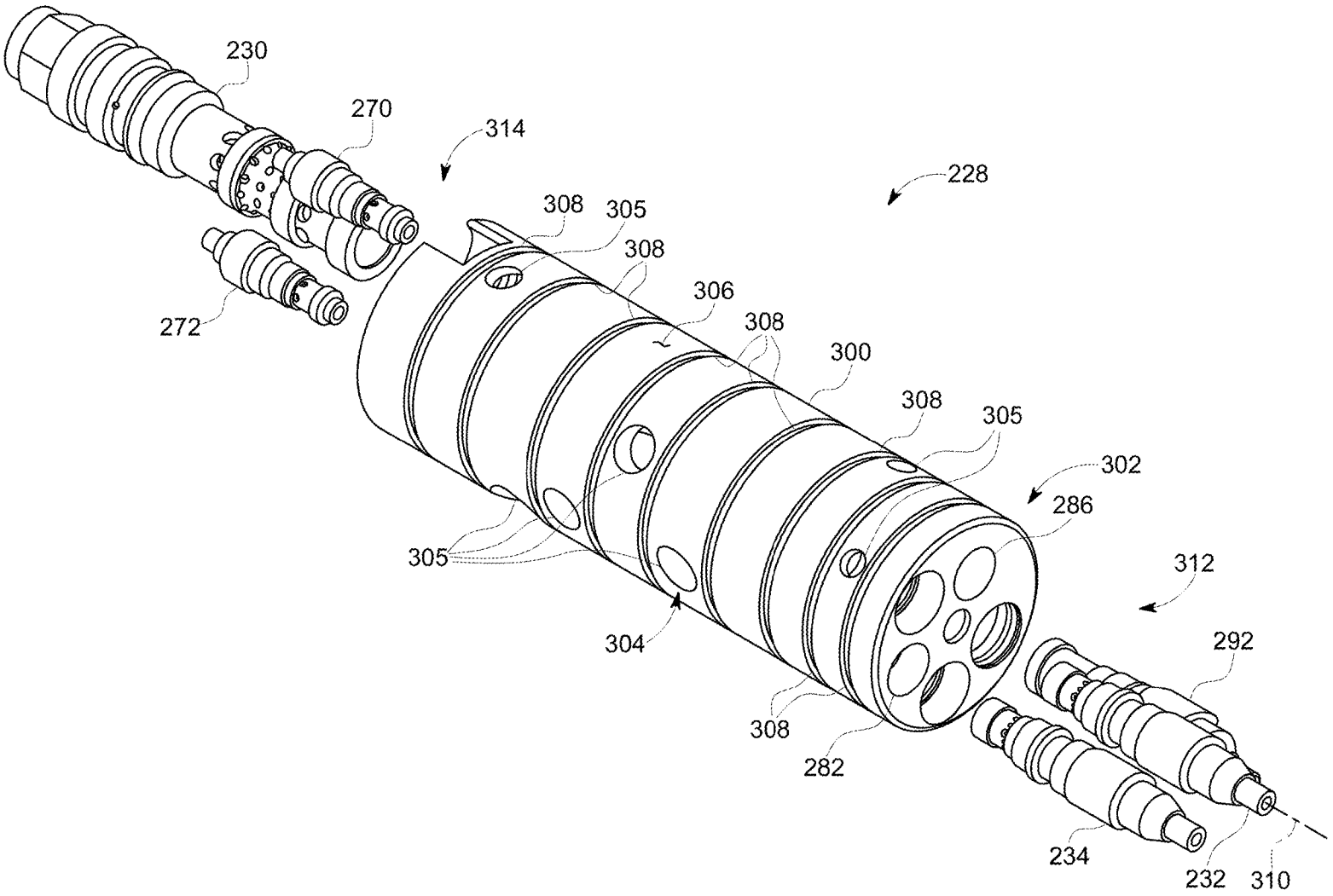
FIG. 8 is an exploded perspective view of the manifold assembly shown in FIG. 6.

As described herein, hydraulic actuator 114 includes valve manifold assembly 228 for channeling the pressurized fluid to piston section 120 to operate piston rod pump assembly 112. FIG. 6 is a perspective view of valve manifold assembly 228 for use in hydraulic actuator 114 (shown in FIGS. 1 and 2). FIG. 7 is another perspective view of valve manifold assembly 228, looking from an opposite end of valve manifold assembly 228. FIG. 8 is an exploded perspective view of manifold assembly 228. In the exemplary embodiment, valve manifold assembly 228 is a substantially cylindrical in shape to facilitate fitting within downhole tubing 104 (shown in FIG. 1) and includes fluid circuit 200 defined therein. Valve manifold assembly 228 includes a compact cylindrical manifold body 300 having a plurality of fluid passages 302 defined therein. In the exemplary embodiment, the plurality of fluid passages 302 extend substantially axially along manifold body 300 and form at least a portion of fluid circuit 200. Manifold body 300 also includes a plurality of cross-drilled fluid passages 304 that extend generally radially through an outer surface 306 of manifold body 300 defining apertures 305 in outer surface 306. Cross-drilled fluid passages 304 facilitate coupling one or more of fluid passages 302 in fluid communication within manifold body 300 to form fluid circuit 200.

In the exemplary embodiment, valve manifold assembly 228 includes a first end 312 and a second end 314. First end 312 includes a first end surface 316 that includes an opening for fluid supply passage 282 and fluid return passage 286. In addition, first end surface 316 includes provisions for coupling first pressure actuated valve 232, second pressure actuated valve 234, and pressure relief valve 292 to fluid circuit 200 defined therein, as shown in FIG. 5. Second end 314 includes a second end surface 318 that includes an opening for head end hydraulic passage 238 and base end hydraulic passage 240. In addition, second end surface 318 includes provisions for coupling control valve 230 and inline needle valves 270 and 272 to fluid circuit 200 defined therein, as shown in FIG. 5.

Manifold body 300 also includes a plurality of circumferential grooves 308 formed in outer surface 306. In the exemplary embodiment, each one of grooves 308 are formed generally perpendicular to a longitudinal axis 310 of manifold body 300 and have a generally rectangular-shaped cross-section configured to receive a sealing member 344, such as an O-ring (shown in FIG. 14). In alternative embodiments, grooves 308 have any cross-sectional shape that enables manifold body 300 to function as described herein. Grooves 308 are spaced along an axial length of manifold body 300 such that a single cross-drilled fluid passage 304 extends through outer surface 306 between a respective pair of adjacent grooves 308. That is, grooves 308 are spaced to facilitate isolating respective cross-drilled fluid passages 304 from each other along outer surface 306 of manifold body 300, which is described in more detail herein.

Figure 9:
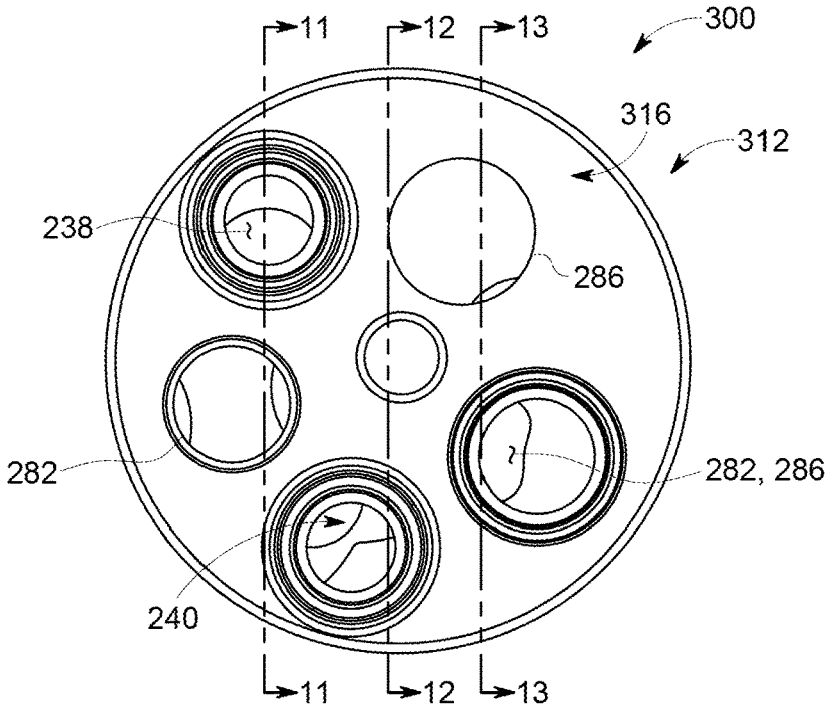
FIG. 9 is a schematic end view of a first end of a manifold for use in the manifold assembly shown in FIG. 6.
Figure 10:
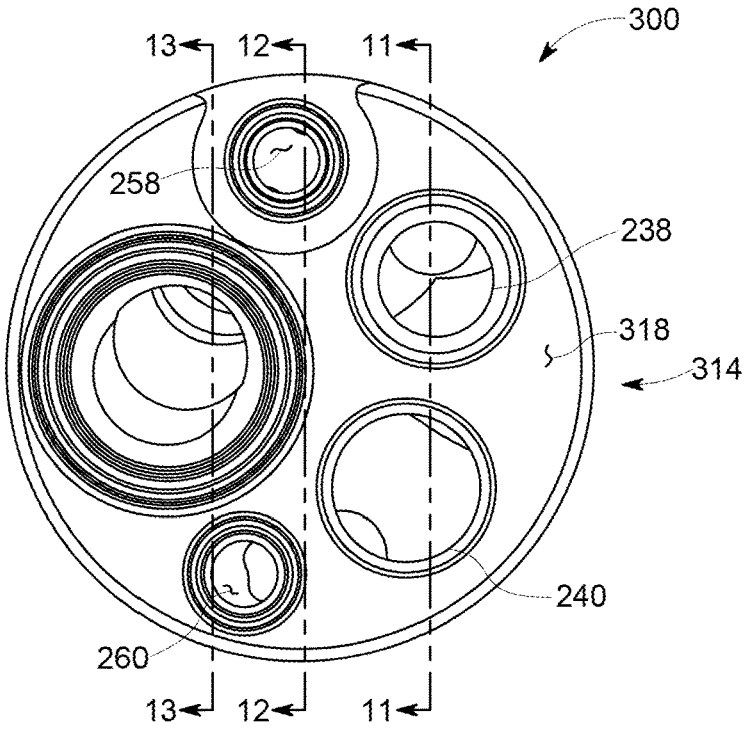
FIG. 10 is a schematic end view of a second end of the manifold shown in FIG. 9.

FIG. 9 is a schematic end view of first end 312 of manifold body 300 for use in manifold assembly 228 (shown in FIGS. 6-8). FIG. 10 is a schematic end view of second end 314 of manifold body 300. With reference to FIGS. 6-10, in the exemplary embodiment, manifold body 300 valve manifold 228 is a unitary component fabricated from a single piece of a metallic material using typical machining techniques, including, for example, drilling and boring, to facilitate reducing the cost and time required to fabricate manifold body 300. Alternatively, manifold body 300 is a unitary component manufactured using for example, and without limitation, additive manufacturing techniques. In the exemplary embodiment, fluid circuit 200 (shown in FIG. 5) is formed by drilling and/or boring a plurality of axially extending fluid passages 302 through manifold body 300. A plurality of a plurality of cross-drilled fluid passages 304 are formed through outer surface 306 of manifold body 300, and are oriented and located to connected one or more of fluid passages 302 to form fluid circuit 200, as described herein.

Figure 11:
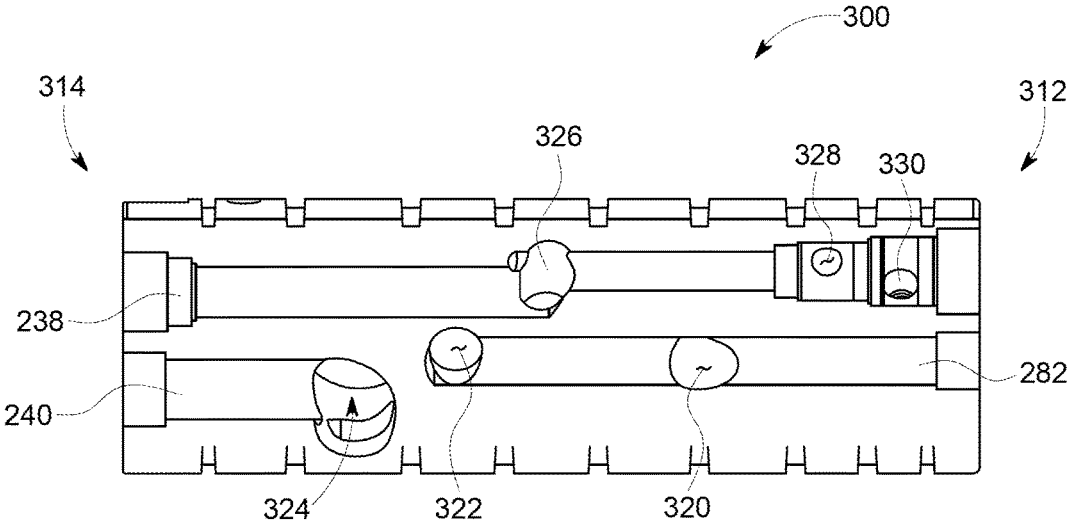
FIG. 11 is a schematic sectioned view of the manifold shown in FIG. 9.

FIG. 11 is a schematic sectioned view of manifold body 300 taken along line 11-11 (shown in FIGS. 9 and 10). In the exemplary embodiment, fluid supply passage 282 extends generally axially through at least a portion of manifold body 300 from first end 312. A cross-drilled fluid passage 320 intersects fluid supply passage 282 to facilitate channeling pressurized fluid to pressure relief valve 292 (shown in FIG. 6). Fluid supply passage 282 also includes a cross-drilled fluid passage 322 configured to channel pressurized fluid to control valve 230 (shown in FIG. 7). Base end hydraulic passage 240 extends generally axially through at least a portion of manifold body 300 from second end 314. A cross-drilled fluid passage 324 intersects base end hydraulic passage 240 to channel pressurized fluid to control valve 230.

In the exemplary embodiment, manifold body 300 also includes head end hydraulic passage 238, which extends generally axially through at least a portion of manifold body 300 from second end 314. A cross-drilled fluid passage 326 intersects head end hydraulic passage 238 to channel pressurized fluid to control valve 230. At first end 312 of manifold body 300, head end hydraulic passage 238 is configured to receive first pressure actuated valve 232 (shown in FIG. 6), such that first pressure actuated valve 232 is coupled in fluid communication with head end hydraulic passage 238, as illustrated in FIG. 5. A cross-drilled fluid passage 328 intersects head end hydraulic passage 238 proximate first end 312 to channel pressurized fluid from first pressure actuated valve 232 to inline needle valve 270 through hydraulic control passage 258 (shown in FIG. 12). In addition, another cross-drilled fluid passage 330 intersects head end hydraulic passage 238 proximate first end 312 to channel fluid from hydraulic control passage 258 to fluid return passage 286.

Figure 12:
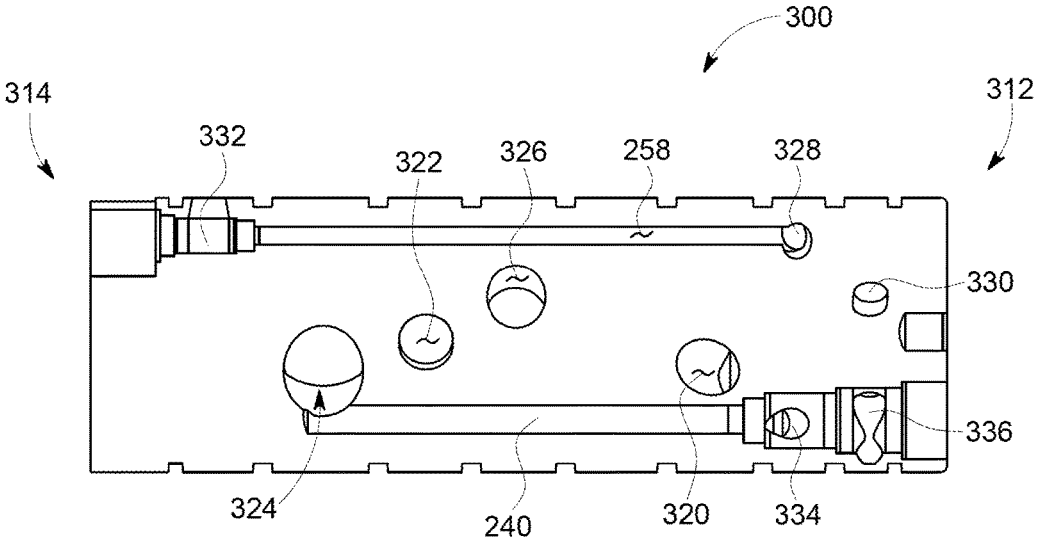
FIG. 12 is another sectioned view of the manifold shown in FIG. 9.

FIG. 12 is another schematic sectioned view of manifold body 300 taken along line 12-12 (shown in FIGS. 9 and 10). In the exemplary embodiment, base end hydraulic passage 240 extends axially to first end 312 and is configured to receive second pressure actuated valve 234 (shown in FIG. 6), such that second pressure actuated valve 234 is coupled in fluid communication with base end hydraulic passage 240, as illustrated in FIG. 5. A cross-drilled fluid passage 334 intersects base end hydraulic passage 240 proximate first end 312 to channel pressurized fluid from second pressure actuated valve 234 to inline needle valve 272 through hydraulic control passage 260 (shown in FIG. 13). In addition, another cross-drilled fluid passage 336 intersects base end hydraulic passage 240 proximate first end 312 to channel fluid from hydraulic control passage 260 to fluid return passage 286.

In the exemplary embodiment, hydraulic control passage 258 extends generally axially through at least a portion of manifold body 300 from second end 314 to cross-drilled fluid passage 328. Hydraulic control passage 258 is configured to receive inline needle valve 270 at second end 314, such that inline needle valve 270 is coupled in fluid communication with control valve 230, as illustrated in FIG. 5. Hydraulic control passage 258 includes an intersecting cross-drilled fluid passage 332 proximate second end 314 to channel pressurized fluid from inline needle valve 270 to control valve 230.

Figure 13:
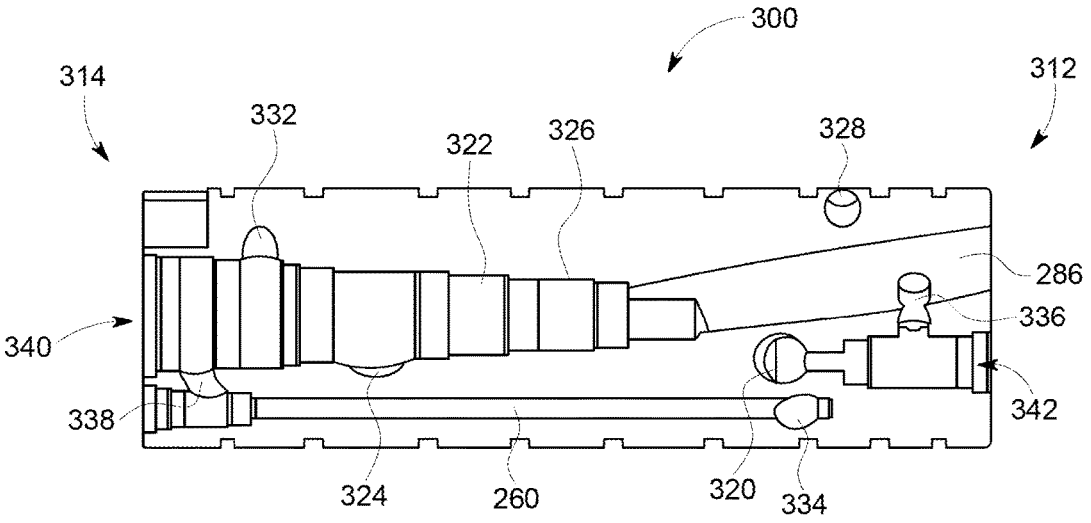
FIG. 13 is yet another sectioned view of the manifold shown in FIG. 9.

FIG. 13 is another schematic sectioned view of manifold body 300 taken along line 13-13 (shown in FIGS. 9 and 10). In the exemplary embodiment, fluid return passage 286 extends in a generally axial direction from first end 312 and intersects a stepped bore 340 configured to receive control valve 230. Stepped bore 340 extend axially from second end 314 at least partially through manifold body 300. Stepped bore 340 is configured to receive control valve 230 therein, and is coupled in fluid communication with and at least partially defines cross-drilled fluid passages 322, 324, 326, 332, and 338. A bore 342 extends from first end 312 and intersects cross-drilled fluid passages 320 and 336. Bore 342 is configured to receive pressure relief valve 292 therein for channeling pressurized fluid from fluid supply passage 282 to fluid return passage 286 in the case of over-pressure of the pressurized fluid.

In the exemplary embodiment, hydraulic control passage 260 extends generally axially through at least a portion of manifold body 300 from second end 314 to cross-drilled fluid passage 334. Hydraulic control passage 260 is configured to receive inline needle valve 272 at second end 314, such that inline needle valve 272 is coupled in fluid communication with control valve 230, as illustrated in FIG. 5. Hydraulic control passage 260 includes intersecting cross-drilled fluid passage 338 proximate second end 314 to channel pressurized fluid from inline needle valve 272 to control valve 230.

Figure 14:
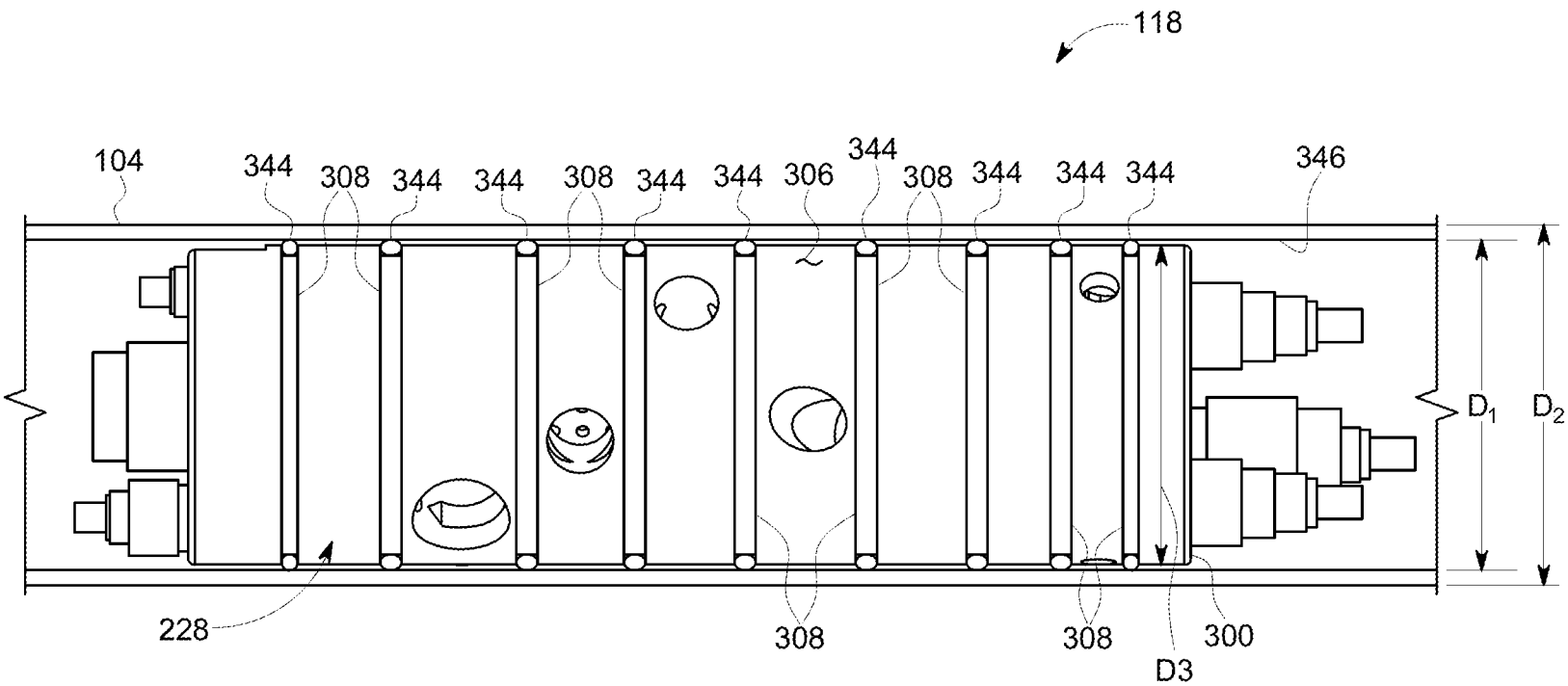
FIG. 14 is a schematic view of a portion of the hydraulic actuator shown in FIG. 2, including the manifold assembly shown in FIG. 6, positioned in a portion of downhole tubing shown in FIG. 1.

FIG. 14 is a schematic view of a portion of control section 118, including manifold assembly 228 positioned in a portion of downhole tubing 104. In the exemplary embodiment, manifold assembly 228 is positioned in a section of downhole tubing 104. Each one of grooves 308 formed in outer surface 306 of manifold body 300 includes an O-ring 344 that extends about manifold body 300. O-rings 344 are sized and shaped to seal against an inner surface 346 of downhole tubing 104 and a respective groove 308 of manifold body 300. As such, O-rings 344 facilitate isolating respective cross-drilled fluid passages 304 from each other along outer surface 306 of manifold body 300.

In the exemplary embodiment, downhole tubing 104 has a nominal outer diameter $D_2$ of about 10.2 centimeters (cm) (4.0 inches (in.)) and a nominal inner diameter $D_1$ of about 8.9 cm (3.5 in.). Alternatively, downhole tubing 104 has a nominal outer diameter $D_2$ in a range between and including about 4.8 cm (1.9 in.) and about 11.4 cm (4.5 in.), and an associated nominal inner diameter $D_1$ in a range between and including about 2.7 cm (1.06 in.) and about 9.5 cm (4.5 in.). In the exemplary embodiment, manifold body 300 is configured to slide into downhole tubing 104 having a nominal 8.9 cm (3.5 in.) inner diameter $D_1$ and sealing engage inner surface 346 through O-rings 344. As such, manifold body 300 has an outer diameter $D_3$ that is less than 8.9 cm (3.5 in.). In one embodiment, outer diameter $D_3$ is in a range between and including about 8.888 cm (3.499 in.) and about 8.865 cm (3.490 in.).

In operation, actuator pump 226 pressurizes hydraulic fluid and channels the pressurized fluid through fluid supply passage 282. The pressurized fluid enters manifold body 300 where it is channeled to control valve 230 through cross-drilled fluid passage 322. In addition, the pressurized fluid is channeled to pressure relief valve 292 through cross-drilled fluid passage 320. As described herein, the plurality of cross-drilled fluid passages 304, such as passages 320 and 322, extend through outer surface 306 of manifold body 300. As such, at least a portion of the pressurized fluid is channeled out of manifold body 300 through the plurality of cross-drilled fluid passages 304. O-rings 344 create a seal between manifold body 300 and downhole tubing 104 to facilitate isolating the cross-drilled fluid passages from each other such that the pressurized fluid remains in the proper fluid passage of the fluid circuit 200, as illustrated in FIG. 5. In addition, O-rings 344 facilitate maintaining the pressure of the pressurized fluid.

Figure 15:
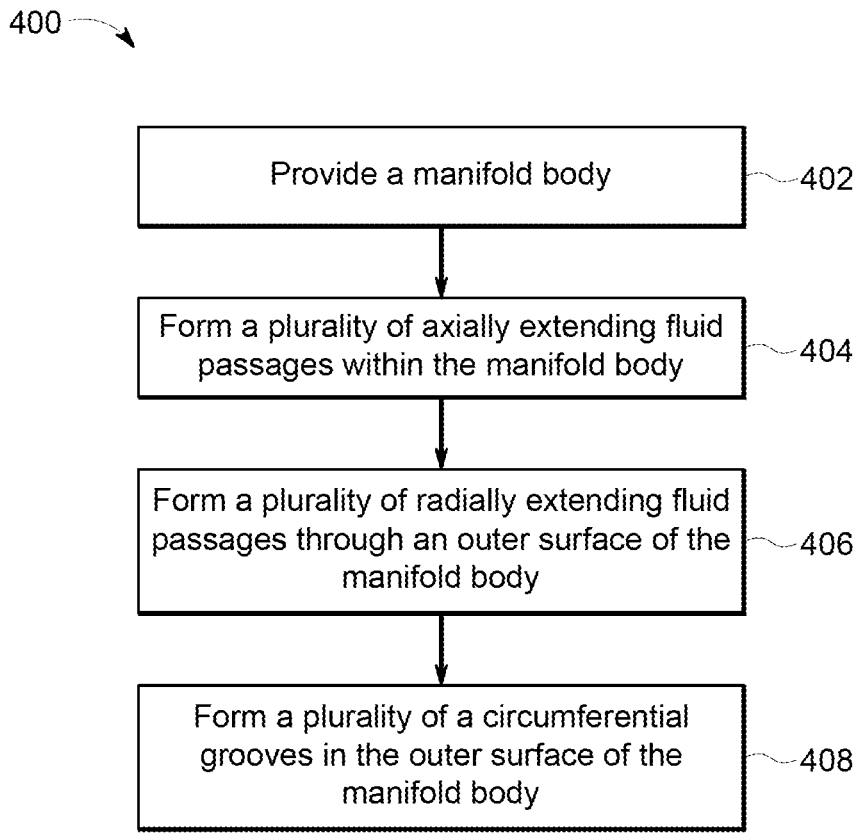
FIG. 15 is a flow chart illustrating a method for assembling the manifold assembly shown in FIG. 6.

FIG. 15 is a flow chart illustrating a method 400 for assembling manifold assembly 228 (shown in FIGS. 6-8). Referring to FIGS. 6-13 and 15, manifold body 300 is provided 402. Manifold body 300 is formed as a cylindrical-shaped body having an outer diameter $D_3$ that is less than 8.9 cm (3.5 in.). In the exemplary embodiment, a plurality of axially extending fluid passages 302 are formed 404 in manifold body 300. In particular, fluid passages 302 are formed by a deep drilling operation. Alternatively, fluid passages 302 are formed by any machining technique that enables manifold assembly 228 to function as described herein. In the exemplary embodiment, a plurality of radially extending cross-drilled fluid passages 304 are formed 406 through outer surface 306 of manifold body 300. The plurality of cross-drilled fluid passages 304 are oriented and positioned to facilitate creating fluid circuit 200 within manifold body 300. The plurality of cross-drilled fluid passages 304 are formed by a deep drilling operation. Alternatively, fluid passages 304 are formed by any machining technique that enables manifold assembly 228 to function as described herein. Furthermore, in the exemplary embodiment, a plurality of circumferential grooves 308 are formed 408 in outer surface 306 of manifold body 300. Each groove 308 is sized and shaped to receive an O-ring 344 therein. In the example embodiment, grooves 308 have a generally rectangular cross-section. Alternatively, grooves 308 can have any cross-sectional shape that enables manifold assembly 228 to function as described herein.

The actuator assemblies described above include a compact mechanical valve manifold assembly configured to reverse a hydraulic fluid flow into a head end and base end of a piston assembly without the use of electronic sensors. In particular, the manifold assembly includes a control valve configured to alternately direct pressurized hydraulic fluid into the head end and base end of the piston assembly, inducing corresponding movement of a drive piston disposed within the piston assembly. The control valve is switched between two configurations, each configuration corresponding to a different fluid flow path, in response to feedback provided by a fluid pressure-based position feedback system. The manifold body is sized to fit within downhole tubing and includes a fluid circuit including a plurality of fluid passages formed by typical, inexpensive manufacturing techniques. The manifold assembly facilitates providing a compact manifold body that defines a fluid pressure feedback system that is sensorless, i.e., free of electronic sensors, and includes a plurality of fluid valves arranged and oriented within downhole space constraints. In addition, the compact manifold body is configured to facilitate ease of manufacturing by using standard drilling techniques to define the fluid passages and cross-drilled passages for defining the fluid circuit. The manifold body also includes a plurality of surface features configured to seal the manifold assembly within the downhole tubing to enable isolation of each cross-drilled passage from another cross-drilled passage.

An exemplary technical effect of the systems and methods described herein includes at least one of: (a) improving reliability of actuator assembly manifolds as compared to electronically controlled actuator assembly manifolds; (b) improving the operational life of actuator assembly manifolds; (c) improving the service life of downhole pump systems including actuator assembly manifolds; and (d) reducing downhole pump manufacturing costs.

Exemplary embodiments of methods, systems, and apparatus for actuator assembly manifolds are not limited to the specific embodiments described herein, but rather, components of systems and/or steps of the methods may be utilized independently and separately from other components and/or steps described herein. For example, the methods, systems, and apparatus may also be used in combination with other pumping systems outside of the oil and gas industry. Rather, the exemplary embodiment can be implemented and utilized in connection with many other applications, equipment, and systems that may benefit from improved reciprocating actuator assemblies.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A downhole manifold assembly comprising:

a manifold body defining a longitudinal axis and comprising:

a first end face, a second end face, and an outer surface extending therebetween; and a fluid circuit defined therein, said fluid circuit comprising a plurality of axially extending fluid passages defined in said manifold body, and a plurality of radially extending fluid passages defined in said manifold body and extending to said outer surface, each radially extending fluid passage of said plurality of radially extending fluid passages defining a respective aperture in said outer surface; and a control valve coupled to said manifold body, said control valve positionable between a first position in which a flow of pressurized fluid is channeled through said fluid circuit in a first direction, and a second position in which the flow is reversed and the pressurized fluid is channeled through said fluid circuit in a second direction.

2. The downhole hydraulic manifold assembly in accordance with claim 1, wherein said manifold body further comprises a plurality of circumferentially-extending grooves defined in said outer surface and spaced axially along said manifold body.

3. The downhole hydraulic manifold assembly in accordance with claim 2, wherein a single said respective aperture is positioned between adjacent grooves of said plurality of circumferentially-extending grooves.

4. The downhole hydraulic manifold assembly in accordance with claim 1, wherein said fluid circuit comprises a pressure-based position feedback system comprising a pressure actuated valve coupled to said manifold body and in fluid communication with said control valve and said plurality of axially extending fluid passages.

5. The downhole hydraulic manifold assembly in accordance with claim 4, wherein said pressure actuated valve receives the pressurized fluid from said fluid circuit and channels the pressurized fluid to said control valve to facilitate transitioning said control valve from one of said first position and said second position to the other of said first position and said second position, said pressure actuated valve configured open in response to a predetermined pressure.

6. The downhole hydraulic manifold assembly in accordance with claim 4, wherein said pressure-based position feedback system further comprises an inline needle valve coupled to said manifold body and in fluid communication with said control valve and said plurality of axially extending fluid passages.

7. The downhole hydraulic manifold assembly in accordance with claim 6, wherein said inline needle valve receives the pressurized fluid from said pressure actuated valve and channels the pressurized fluid to said control valve to facilitate transitioning said control valve from one of said first position and said second position to the other of said first position and said second position, said pressure actuated valve configured open in response to a predetermined pressure.

8. The downhole hydraulic manifold assembly in accordance with claim 1, wherein said plurality of axially extending fluid passages comprises a first hydraulic fluid passage extending to said first end face, and a second hydraulic fluid passage extending to said second end face.

9. The downhole hydraulic manifold assembly in accordance with claim 1, wherein each radially extending fluid passage of said plurality of radially extending fluid passages is configured to connect at least one axially extending fluid passage to at least one other axially extending fluid passage.

10. The downhole hydraulic manifold assembly in accordance with claim 1 further comprising a pressure relief valve coupled to said manifold body, wherein said plurality of axially extending fluid passages comprises a fluid supply passage and a fluid return passage, said pressure relief valve configured to directly channel the pressurized fluid from said fluid supply passage to said fluid return passage based on a predetermined pressure.

11. A downhole pump system comprising:

downhole tubing; and a pump assembly coupled to said downhole tubing, said pump assembly comprising:

a piston housing comprising a head end and a base end opposite said head end;

a drive piston disposed within said piston housing and movable between a first piston position proximate to said head end and a second piston position proximate to said base end; and a manifold assembly disposed within said downhole tubing, said manifold assembly comprising:

a cylindrical manifold body defining a longitudinal axis and comprising:

a first end face, a second end face, and an outer surface extending therebetween;

a plurality of circumferentially-extending grooves defined in said outer surface and spaced axially along said cylindrical manifold body; and a fluid circuit defined therein and coupled in flow communication with said head end and said base end, said fluid circuit comprising a plurality of radially extending fluid passages defined in said cylindrical manifold body and extending to said outer surface, each radially extending fluid passage of said plurality of radially extending fluid passages defining a respective aperture in said outer surface, wherein a single said respective aperture is positioned between adjacent grooves of said plurality of circumferentially-extending grooves.

12. The downhole pump system is accordance with claim 11, wherein said manifold assembly further comprises a plurality of sealing members, wherein a respective sealing member of said plurality of sealing members is disposed in a respective groove of said plurality of circumferentially-extending grooves.

13. The downhole pump system is accordance with claim 12, wherein each said respective sealing member is configured to seal against an inner surface of said downhole tubing and said respective groove of said manifold body to facilitate isolating said each radially extending fluid passage from each other and to facilitate maintaining the pressure of the pressurized fluid.

14. The downhole pump system is accordance with claim 11, wherein said cylindrical manifold body comprises an outer diameter in a range between and including about 8.888 cm (3.499 in.) and about 8.865 cm (3.490 in.).

15. The downhole pump system is accordance with claim 11, wherein said fluid circuit further comprises a plurality of axially extending fluid passages defined in said cylindrical manifold body.

16. The downhole pump system is accordance with claim 11, wherein said manifold assembly further comprises a control valve coupled to said cylindrical manifold body, said control valve positionable between a first position in which a flow of pressurized fluid is channeled through said fluid circuit in a first direction, and a second position in which the flow is reversed and the pressurized fluid is channeled through said fluid circuit in a second direction.

17. The downhole pump system is accordance with claim 16, wherein said fluid circuit comprises a pressure-based position feedback system comprising:

a first pressure actuated valve coupled to said cylindrical manifold body and in fluid communication with said control valve and said head end; and a second pressure actuated valve coupled to said cylindrical manifold body and in fluid communication with said control valve and said base end.

18. The downhole pump system is accordance with claim 17, wherein said first pressure actuated valve is configured to facilitate transitioning said control valve from said first position to said second position in response to a predetermined head end pressure.

19. The downhole pump system is accordance with claim 17, wherein said second pressure actuated valve is configured to facilitate transitioning said control valve from said second position to said first position in response to a predetermined base end pressure.

20. A method for assembling a manifold assembly, said method comprising:

providing a cylindrical manifold body;

forming a plurality of axially extending fluid passages in the cylindrical manifold body;

forming a plurality of radially extending fluid passages in the cylindrical manifold body, each radially extending fluid passage of the radially extending fluid passages extending to an outer surface of the cylindrical manifold body; and forming a plurality of circumferentially-extending grooves in the outer surface of the cylindrical manifold body, wherein the plurality of circumferentially-extending grooves are spaced axially along the cylindrical manifold body, and wherein a single radially extending fluid passage extends to the outer surface between adjacent grooves of the plurality of circumferentially-extending grooves.

21. The method in accordance with claim 20, wherein forming a plurality of axially extending fluid passages comprises performing drilling operations on the cylindrical manifold body.

22. The method in accordance with claim 20, wherein forming a plurality of radially extending fluid passages comprises performing drilling operations through the outer surface of the cylindrical manifold body.

23. The method in accordance with claim 20, wherein providing a cylindrical manifold body comprises providing the cylindrical manifold body with an outer diameter in a range between and including about 8.888 cm (3.499 in.) and about 8.865 cm (3.490 in.).

* * * * *